United States Patent [19]

Moss et al.

[11] 3,950,105

[45] Apr. 13, 1976

[54] PORTABLE SKI WAX APPLICATOR

[76] Inventors: Arnold T. Moss, 4442 Village Road, Long Beach, Calif. 90808; Steele Quinton Therkleson, 9911 Annik Drive, Huntington Beach, Calif. 92646; Anton Magnet, 11208 Firmona Ave., Inglewood, Calif. 90304

[22] Filed: Apr. 17, 1975

[21] Appl. No.: 569,312

[52] U.S. Cl. ..... 401/1; 401/2

[51] Int. Cl. ..... A47l 13/32

[58] Field of Search ..... 401/1, 2

[56] References Cited

UNITED STATES PATENTS

| | | | |
|---|---|---|---|
| 2,118,415 | 5/1938 | Pesark | 401/1 |

FOREIGN PATENTS OR APPLICATIONS

| | | | |
|---|---|---|---|
| 86,396 | 7/1920 | Switzerland | 401/1 |
| 960,164 | 3/1957 | Germany | 401/1 |
| 963,307 | 12/1949 | France | 401/1 |
| 1,078,165 | 5/1954 | France | 401/1 |

*Primary Examiner*—Lawrence Charles

*Attorney, Agent, or Firm*—Fulwider, Patton, Rieber, Lee & Utecht

[57] ABSTRACT

A portable ski wax applicator including a heat conductive box-like, wax-receiving compartment having an inlet in the top wall thereof for receipt of wax. One end of the compartment is formed with a plurality of through wax metering orifices which terminate at their outer extremities adjacent an elongated spreader for spreading wax metered therethrough. An electrical heater is mounted within such housing for heating wax received therein and a low coefficient of heat transfer handle is secured to such housing whereby wax may be received in such opening and heated to flow out such orifices as the applicator is passed over the surface of a ski to be waxed for spreading wax in a uniform layer thereon.

5 Claims, 7 Drawing Figures

FIG. 1
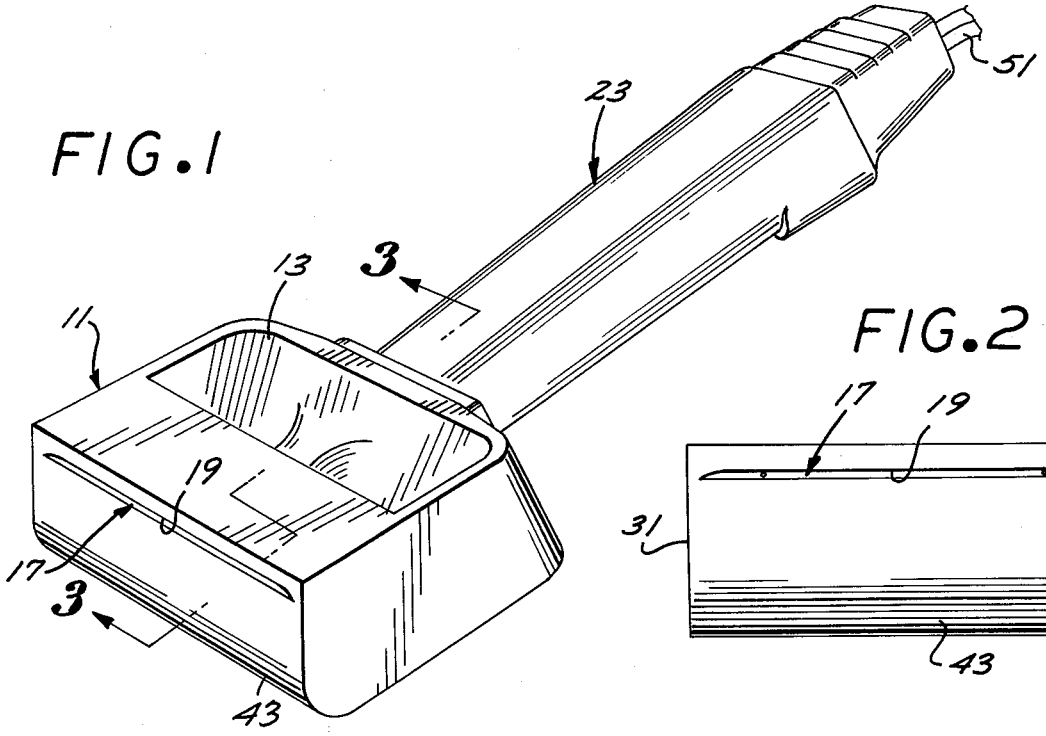
FIG. 2
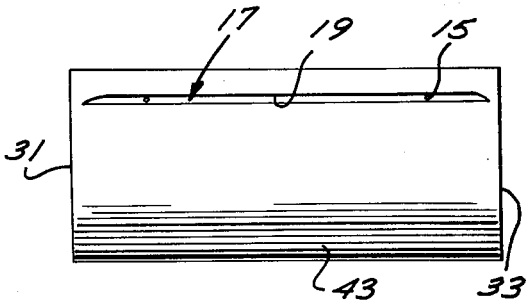
FIG. 3
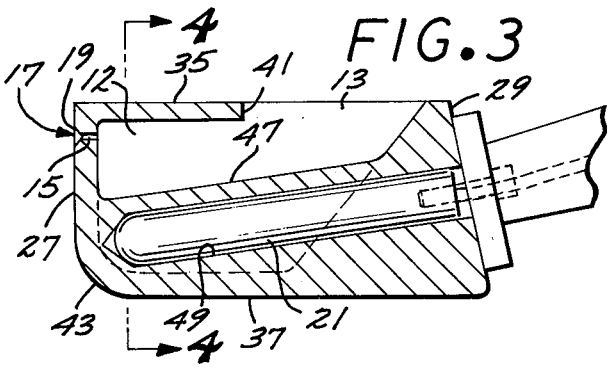
FIG. 4
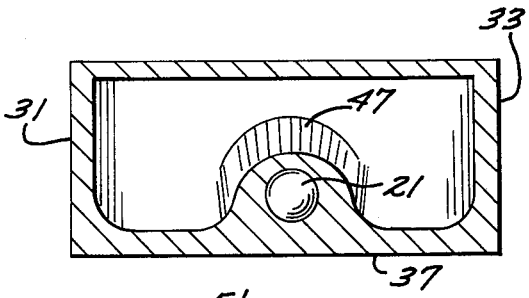
FIG. 6
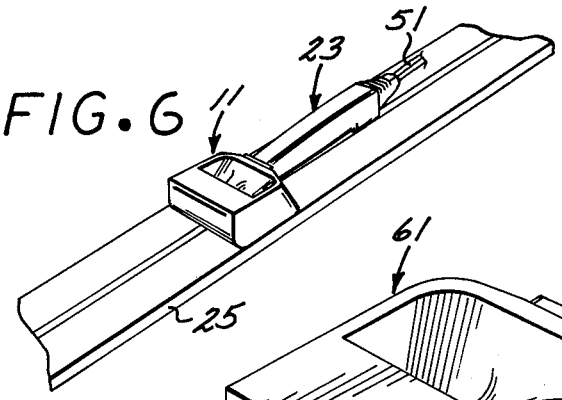
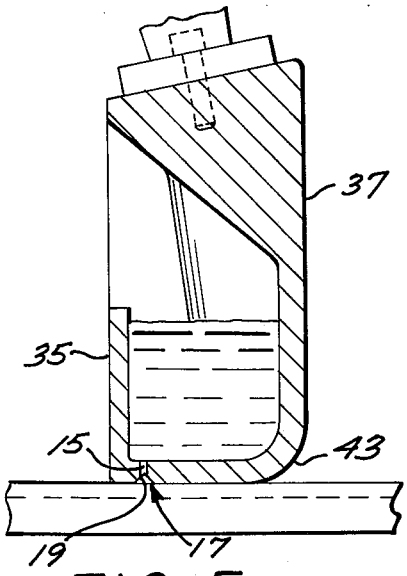
FIG. 5
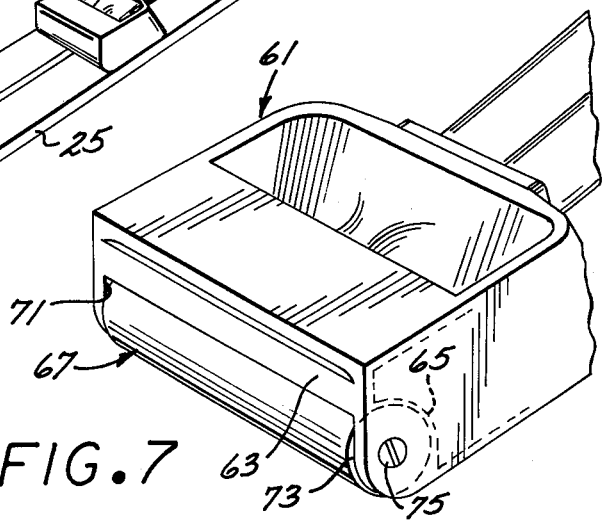
FIG. 7

PORTABLE SKI WAX APPLICATOR

BACKGROUND OF THE INVENTION

1. Field of the Invention

The portable ski was applicator of the present invention relates to a device for applying hot wax to skis.

2. Description of the Prior Art:

It has been common practice throughout the years to cold wax the bottom of a pair of snowskis by rubbing a bar of the selected grade of cold wax thereon. Further, in many ski areas an overnight service is available for applying hot was to snow skis. Normally, such wax is applied by placing the wax in a hot wax bath and then spreading the wax on the bottom of a pair of skis by means of an applicator brush or the like. Some such baths include a roller mounted in the tops thereof and arranged to be partially submerged in hot wax melted in such bath for rolling of wax on skis passed thereover. However, heretofore there have been no portable ski wax applicators which are convenient to pack and carry on a ski trip to be available for use each night as required by the skier to rapidly and conveniently apply a coat of wax to his skis as dictated by the ski conditions and intensity with which that particular skier approaches the sport.

SUMMARY OF THE INVENTION

The portable ski wax applicator of the present invention is characterized by a heat conductive housing formed with a compartment having its top wall formed with an inlet disposed at one end thereof and a plurality of through wax metering orifices at the opposite end thereof, such orifices terminating at their outer extremities in oulets disposed adjacent a spreader whereby the applicator may be stood on end with the spreader in contact with the ski and the melted wax metered through such orifices to be spread on the ski surface by means of such spreader.

DESCRIPTION OF THE DRAWING

FIG. 1 is a perspective view of a portable ski wax applicator embodying the present invention;

FIG. 2 is an end view of the portable ski wax applicator shown in FIG. 1;

FIG. 3 is a broken longitudinal sectional view taken along the line 33 of FIG. 1;

FIG. 4 is a tranverse sectional view taken along the line 4—4 of FIG. 3;

FIG. 5 is a sectional view similar to FIG. 3 but showing the applicator in its upright position;

FIG. 6 is a perspective view, in reduced scale, depicting the applicator shown in FIG. 1 smoothing wax on the bottom of a ski; and FIG. 7 is a partial perspective view of a second embodiment of the portable ski wax applicator of the present invention.

DESCRIPTION OF THE PREFERRED EMBODIMENTS

The portable ski wax applicator of the present invention includes, generally, a box-shaped heat conductive housing 11 formed at one extremity of its top with an inlet opening 13 and including in its opposite extremity a plurality of through metering orifices 15 which terminate at their outer extremities in metering outlets opening into a dispersion groove 17 (FIG. 3) having one side thereof which defines a spreader 19 (FIG. 5). Referring to FIG. 3, mounted within the housing 11 is an electrical heating element 21 and projecting from the back side thereof is a low coefficient of heat transfer handle 23. Consequently, wax may be received within the opening 13 and heated by means of the heater 21 to be melted into a liquid form. The handle 23 may be grasped by the operator and the housing manipulated to its upright position shown in FIG. 3 to meter wax from the metering orifices 15 and into the dispersion groove 17 to be spread on the surface of a ski 25 as the applicator is drawn to the left along the ski as shown in FIG. 5.

Referring to FIGS. 3 and 4, the housing 11 may be constructed of aluminum or other heat conductive material and in the preferred embodiment is formed with front and rear walls 27 and 29, side walls 31 and 33 and top and bottom walls 35 and 37, respectively. The housing 11 is of generally rectangular construction having an overall length of about 3 inches, a width of 3½ inches and a depth of 1½ inches. The top wall 35 terminates at one end in an edge 41 spaced 1½ inches from the back wall 29 to form the inlet opening 13 of sufficient size to receive a wax bar of conventional width and thickness. There are two metering orifices 15 and each is formed by a bore having a diameter of 0.030 inches to provide the desired flow rate therethrough for metering the required amount of wax for conditioning a conventional width ski in a single pass thereover at a hand speed. Referring to FIG. 3, the lower front corner of the housing 11 is formed with a semicirular arc to define a smoothing surface 43 for smoothing the wax dispensed on the ski surface.

The interior of the housing 11 is formmed with a forwardly and rearwardly projecting, conically shaped hump 47 having a longitudinal bore 49 formed therein for receipt of the heating element 21 (FIG. 3).

Referring to FIGS. 2 and 3, the dispersion groove is V-shaped-in-cross section and is preferably about 1/16 of an inch with the walls thereof diverging apart at an angle of about 60° from one another. While the spreader 15 could be formed by any transversely extending surface, the dispersion groove 17 is preferable in that it provides for flow therealong of the wax metered from the metering orifices 15.

The handle 23 may be made of any thermally insulative material and in the preferred embodiment is constructed of Bake-o-lite. Electrical leads 51 project through such handle for connection on one end with the heating element (FIG. 3) and on the opposite end with an electrical plug (not shown).

In operation, it will be appreciated that the ski wax applicator of the present invention is sufficiently compact to enable it to be conveniently packed in the skier's luggage for convenient portage to the ski area selected for the weekend or an extended vacation. At night when the skier returns from the slopes and desires to improve the bottom surface of his skis by applying hot wax thereto, the applicator may be plugged into a 110 AC source and a chunk of wax broken from a solid bar and deposited in the compartment 12 through the inlet opening 13 to be melted by the heat from the heating element 21. As long as the housing 11 rests on its bottom wall 37 as shown in FIG. 3 and the wax remains below the level of the metering orifices 15, such wax will be retained within the compartment 12, thus preventing spillage thereof.

Referring to FIGS. 5 and 6, in operation the ski 25 to be waxed may be placed upside down on the floor or other support surface and the handle 23 of the applicator grasped and such applicator manipulated to its upstanding position shown in FIG. 5 over the ski 25 to communicate the fluid wax contained therein with the metering orifices 15 to meter such wax from such orifices and into the opposite extremities of the dispersion groove 17. The wax received in such dispersion groove will be communicated longitudinally therealong to be spread on the bottom surface of the ski as such applicator is drawn along such ski and the soft wax spread by the spreader 19. After the initial pass, the applicator may be lowered to its smoothing position shown in FIG. 6 with the hot bottom wall 37 held flush with the ski bottom and the applicator passed over such ski, but from right to left as viewed in FIG. 6, to cause the finishing surface 43 to flatten the applied wax and the bottom wall 37 to further smooth and thin such wax, as well as impregnate the wax to the ski surface. After waxing of both skis of a pair has been completed, the applicator may conveniently be unplugged to enable cooling thereof to solidify the wax therein and the applicator conveniently stored until use thereof is again required.

The applicator shown in FIG. 7 is of substantially the same constuction as that shown in FIGS. 1–6, except that the housing, generally designated 61, is formed with a generally flat front wall 63 having a semicylindrical cavity 65 formed in the bottom portion thereof for receipt of a metallic finishing roller, generally designated 67. The housing 61 is formed at its opposite ends with mounting flanges 71 and 73 defining the opposite ends of the semicircular cavity 65 and overlying the opposite ends of such roller 67. The roller 67 is mounted from the flanges 71 and 73 by means of mounting screws 75 which support such roller recessed below the flat exterior portion of the wall 63 but having its lower cylindrical surface projecting below the plane of the bottom wall 37.

The applicator shown in FIG. 7 operates substantially the same as the applicator shown in FIGS. 1–6 except that after application of the hot wax, such wax may be further smoothed by rolling the hot finishing roller 67 thereover.

Various modifications and changes may be made with regard to the foregoing detailed description without departing from the spirit of the invention.

We claim:

1. A portable ski wax applicator comprising:

a heat conductive housing formed with a wax receiving compartment having top, bottom and respective first and second oppositely disposed side and end walls;

an inlet formed in said top wall adjacent said first end wall;

an elongated exterior dispersion groove formed in said second end wall proximate the top thereof and extending longitudinally of said top wall with one side thereof defining a spreader;

a plurality of through wax metering orifices formed in said second end wall and terminating at outlets spaced apart longitudinally in said groove, disposed ahead of said spreader;

an electrical heater mounted in said bottom wall; and a low coefficient of heat transfer handle projecting from said housing whereby solid wax may be introduced through said inlet into said compartment to be melted by heat from said heater, said handle grasped to manipulate said housing to abut said second end wall flush against the bottom of a ski to cause melted wax to be metered onto said orifices to pour into said dispersion groove to run longitudinally therein and said spreader drawn along said ski to cause said spreader to spread said melted wax evenly therealong.

2. A portable ski wax applicator as set forth in claim 1 wherein:

said compartment is formed in said bottom wall with an elongated hump projecting coextensive with said side walls and bisecting said compartment and wherein:

said heater is mounted in said hump.

3. A portable ski wax applicator as set forth in claim 1 that includes:

a finishing roller rotatably mounted on said second wall for rolling over wax applied to said ski.

4. A portable ski wax applicator as set forth in claim 1 wherein:

said second end wall is formed on its exterior with an arcuate finishing surface for passing over wax applied to said ski.

5. A portable ski wax applicator as set forth in claim 1 wherein:

said metering orifices are formed by through bores having a diameter of substantially 0.030 inches.

* * * * *